US010322840B2

(12) United States Patent
Angulo et al.

(10) Patent No.: US 10,322,840 B2
(45) Date of Patent: Jun. 18, 2019

(54) RECLOSABLE CARTON WITH CARRYING HANDLE

(71) Applicant: Intercontinental Great Brands LLC, East Hanover, NJ (US)

(72) Inventors: Hector Angulo, East Hanover, NJ (US); Edward Barnes, Wayne, NJ (US); Pat Klinger, Wayne, NJ (US); Michael Simonetti, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 15/550,750

(22) PCT Filed: Feb. 12, 2016

(86) PCT No.: PCT/US2016/017675
§ 371 (c)(1),
(2) Date: Aug. 11, 2017

(87) PCT Pub. No.: WO2016/133797
PCT Pub. Date: Aug. 25, 2017

(65) Prior Publication Data

US 2018/0029745 A1 Feb. 1, 2018

Related U.S. Application Data

(60) Provisional application No. 62/118,815, filed on Feb. 20, 2015.

(51) Int. Cl.
*B65D 5/46* (2006.01)
*B65D 5/02* (2006.01)
(Continued)

(52) U.S. Cl.
CPC ..... *B65D 5/46088* (2013.01); *B65D 5/0227* (2013.01); *B65D 5/106* (2013.01);
(Continued)

(58) Field of Classification Search
CPC .. B65D 5/46088; B65D 5/0227; B65D 5/106; B65D 5/46072; B65D 71/36; B65D 5/2057; B65D 5/4616; B65D 5/46032
(Continued)

(56) References Cited

U.S. PATENT DOCUMENTS 267,698 A 11/1882 Ludlow
1,407,483 A 2/1922 Rike
(Continued)

FOREIGN PATENT DOCUMENTS

CN 1304857 7/2001
CN 1309615 8/2001
(Continued)

OTHER PUBLICATIONS

International Search Report and Written Opinion of the International Search Authority, dated May 3, 2016 for International Application No. PCT/US2016/017675 (10 pgs.).
(Continued)

*Primary Examiner* — Christopher R Demeree
(74) *Attorney, Agent, or Firm* — Fitch, Even, Tabin & Flannery LLP

(57) ABSTRACT

A carton for storing products therein includes top, bottom, and side panels defining an interior configured to store products therein and an access opening configured to permit the products to be removed from the carton when the carton is in an open configuration. The top panels include a first top panel hingedly attached to one of the side panels and a second top panel hingedly connected to another of the side panels. The second top panel includes a handle surrounding an opening and a closure tab extending into the opening. The first top panel includes a slot configured to receive one or more locking projections of the closure tab.

19 Claims, 8 Drawing Sheets

(51) Int. Cl.
*B65D 5/10* (2006.01)
*B65D 71/36* (2006.01)

(52) U.S. Cl.
CPC ..... *B65D 5/46072* (2013.01); *B65D 71/36* (2013.01); *B65D 2571/0066* (2013.01); *B65D 2571/00141* (2013.01); *B65D 2571/00481* (2013.01); *B65D 2571/00512* (2013.01); *B65D 2571/00635* (2013.01); *B65D 2571/00728* (2013.01)

(58) Field of Classification Search
USPC .... 229/117.09, 117.14, 155, 117.15, 117.22, 229/185, 193, 194; 206/427; 220/771
See application file for complete search history.

(56) References Cited

U.S. PATENT DOCUMENTS

| | | | | |
|---|---|---|---|---|
| 1,814,816 | A | 7/1931 | Appelbaum | |
| 1,845,471 | A | 2/1932 | Zenick | |
| 1,983,689 | A | 12/1934 | Bedell | |
| 2,004,358 | A | 6/1935 | Wolf | |
| 2,323,782 | A | 7/1943 | Kretchmer | |
| 2,341,762 | A | 2/1944 | Conklin | |
| 2,693,310 | A * | 11/1954 | Stopper | B65D 5/0227 229/117.15 |
| 2,758,778 | A | 8/1956 | Arneson | |
| 2,961,145 | A | 11/1960 | Ellison | |
| 3,013,711 | A | 12/1961 | Kronson | |
| 3,196,759 | A | 7/1965 | Lemanski | |
| 3,239,110 | A | 3/1966 | Buter | |
| 3,341,908 | A | 9/1967 | Lock | |
| D292,487 | S | 10/1987 | Kea | |
| D307,719 | S | 5/1990 | Band | |
| 4,941,624 | A | 7/1990 | Schuster | |
| 5,284,294 | A | 2/1994 | Floyd | |
| 5,358,175 | A | 10/1994 | Cai | |
| 5,472,090 | A | 12/1995 | Sutherland | |
| D396,805 | S | 8/1998 | Broyles | |
| 5,899,377 | A | 5/1999 | Speese | |
| D418,751 | S | 1/2000 | Wolf | |
| D446,448 | S | 8/2001 | Jernigan | |
| 6,866,187 | B2 | 3/2005 | Reagan | |
| 7,143,931 | B2 | 12/2006 | Johnson | |
| 7,204,405 | B2 | 4/2007 | Johnson | |
| 7,380,703 | B2 | 6/2008 | Ogden | |
| 7,699,163 | B2 | 4/2010 | Gomes | |
| 7,743,969 | B2 | 6/2010 | Bokel | |
| 7,775,418 | B2 | 8/2010 | Walling | |
| 7,967,186 | B2 * | 6/2011 | Brandinelli | B65D 5/46032 229/117.19 |
| 7,984,843 | B2 | 7/2011 | Cooper | |
| 7,998,047 | B2 | 8/2011 | Spivey | |
| 8,511,463 | B2 | 8/2013 | Brand | |
| D713,721 | S | 9/2014 | Graves | |
| D721,954 | S | 2/2015 | Kauanui | |
| 9,073,658 | B2 * | 7/2015 | Spivey, Sr. | B65D 5/00 |
| D744,825 | S | 12/2015 | Johansen | |
| D748,496 | S * | 2/2016 | Young | D9/432 |
| 9,248,933 | B2 * | 2/2016 | Spivey, Sr. | B65D 5/46088 |
| D764,288 | S | 8/2016 | Simonetti | |
| 2006/0266812 | A1 | 11/2006 | Von Bokel | |
| 2010/0270367 | A1 | 10/2010 | Brandenburger | |
| 2012/0228319 | A1 | 9/2012 | Cook | |
| 2014/0203070 | A1 | 7/2014 | Lee | |
| 2015/0291304 | A1 | 10/2015 | Bell | |

FOREIGN PATENT DOCUMENTS

| | | |
|---|---|---|
| CN | 203473381 | 3/2014 |
| EP | 2226259 | 9/2010 |
| FR | 2634464 | 1/1990 |
| WO | 9606020 | 2/1996 |
| WO | 02059002 | 8/2002 |
| WO | 2004033328 | 4/2004 |
| WO | 2006130547 | 12/2006 |
| WO | 2008061168 | 5/2008 |
| WO | 2010033657 | 3/2010 |
| WO | 2011026010 | 3/2011 |

OTHER PUBLICATIONS

The State Intellectual Property office of P. R. China, Notification of the First Office Action, dated Aug. 24, 2018, for Chinese Application No. 201680007355.0 (16 pgs.).

* cited by examiner

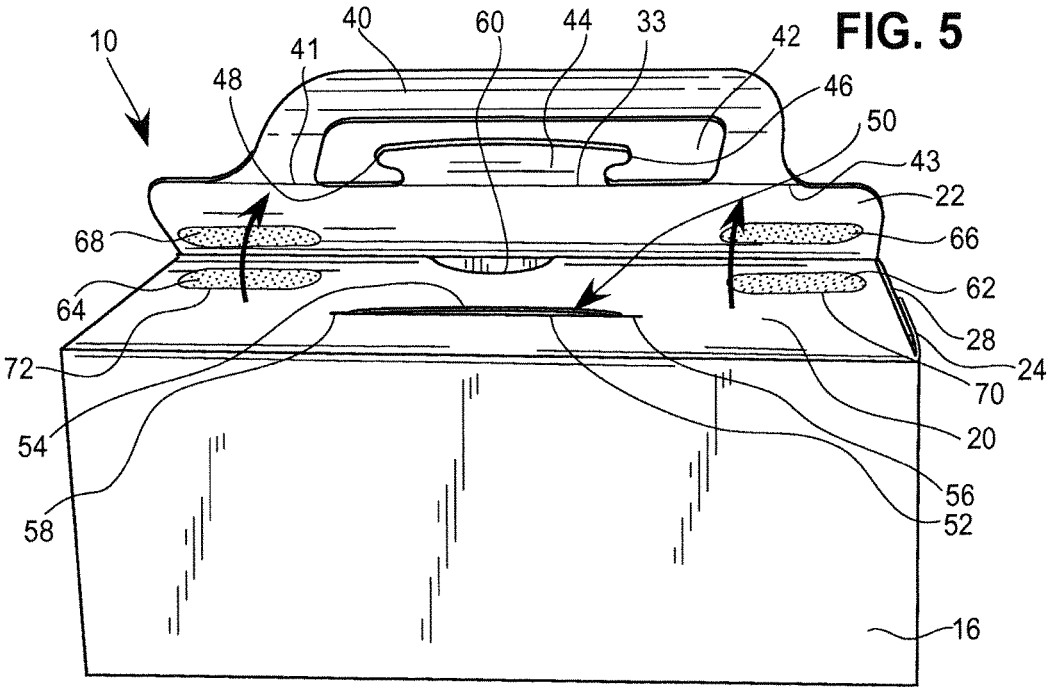
FIG. 5
FIG. 6
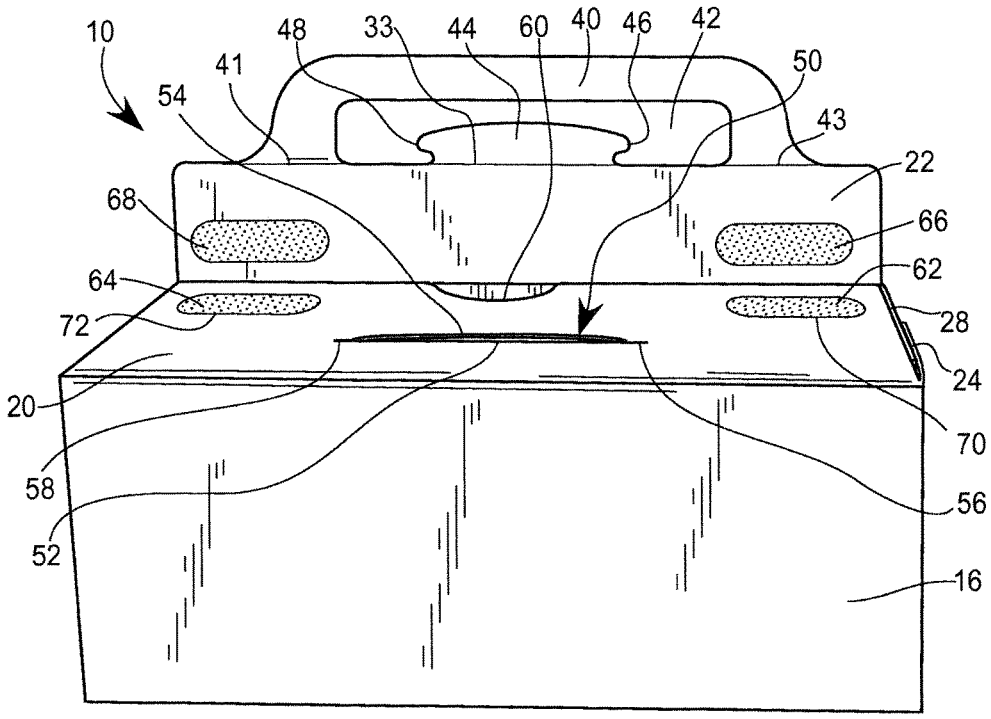

RECLOSABLE CARTON WITH CARRYING HANDLE

CROSS-REFERENCE TO RELATED APPLICATIONS

This application is a U.S. national phase application of International Application No. PCT/US2016/017675, filed Feb. 12, 2016, which claims the benefit of U.S. provisional patent application No. 62/118,815, filed Feb. 20, 2015, which are hereby incorporated herein by reference in their entirety.

FIELD

Cartons including handles and having top panels that open to provide access to the products in the cartons are described herein, and in particular, cartons reclosable after initial opening by interlocking the top panels.

BACKGROUND

Consumer products, and more particularly, children's snacks, can be packaged in cartons with handles that permit the children to carry such cartons by holding the handles. In some cartons, the handles are made of string. In other cartons, the handles can be integral to the top of the carton. Top panels of the carton may be fixedly attached to each other to prevent the handles from being inadvertently ripped off the top of the carton, the cartons may be openable via their side panels. For small children, opening the carton using a side panel instead of opening at the top where the handle is located may be complicated and/or counterintuitive.

Cartons that overcome the above-referenced disadvantages are needed.

SUMMARY

The cartons described herein include an integrated handle and a locking tab that permits reclosure of the carton after initial opening in such a way that the carton remains securely reclosed and remains reclosed while a user carries the carton by holding the handle.

In one form, a carton for storing products therein includes top, bottom, and side panels defining an interior configured to store products therein and an access opening configured to permit the products to be removed from the carton when the carton is in an open configuration. The top panels include a first top panel hingedly attached to one of the side panels and a second top panel hingedly connected to another of the side panels and being removably attached to and overlaying a portion of the first top panel such that the access opening of the carton is obstructed by the first and second top panels when the carton is in a closed configuration. The second top panel includes a handle at least partially defining an opening and a closure tab extending into the opening when coplanar with the handle. The closure tab includes at least one locking projection extending therefrom, and the first top panel includes a slot configured to receive the at least one locking projection of the closure tab.

The side panels may include: a front panel hingedly connected to the bottom panel and a rear panel hingedly connected to the bottom panel; first and second major outer side panels each being hingedly connected to the rear panel; and third and fourth major outer side panels each being hingedly connected to the front panel and overlaying the first and second major outer side panels when the carton is in the closed configuration.

The bottom panel may include first and second minor bottom side panels hingedly connected to the bottom panel, and when the carton is in the closed configuration, the first minor bottom side panel may extend along portions of the first and third major outer side panels, and the second minor bottom side panel may extend along portions of the second and fourth major outer side panels.

The first top panel may include first and second minor top side panels hingedly connected to the first top panel, and when the carton is in the closed configuration, the first and second top side panels may pass through the access opening into the interior, the third minor top side panel may extend along portions of the first and third major outer side panels, and the fourth minor top panel may extend along portions of the second and fourth major outer side panels.

The first top panel may include at least one adhesive area configured to permit detachable attachment of the first and second top panels when the first and second top panels abut. The at least one adhesive area may be at least partially surrounded by a line of weakness configured to facilitate detachment of the at least one adhesive area from the first top panel when the second top panel is moved away from the first top panel.

In one form, the handle has a first position, where the handle is adjacent the second top panel, and a second position, where the handle is upstanding relative to both the first and second top panels when in the closed configuration. The handle may be hingedly connected to the second top panel along at least one hinge line configured to permit movement of the handle from the first position to the second position.

The side panels of the carton may include a front panel and a rear panel opposite the rear panel, and the first and second top panels may be hingedly connected to front and rear panels, respectively, and configured to pivot about their respective hinge lines from the closed configuration to an open configuration to unobstruct the access opening and permit access to the products in the interior.

In one form, the closure tab is hingedly connected to the second top panel and is permitted to pivot relative to the second top panel about a hinge.

In the closed configuration of the carton, the first and second top panels may be attached to each other by at least one adhesive area and the locking tab may overlay the slot of the first top panel without being inserted into the slow of the first top panel.

The carton may include a reclosed configuration after initial opening of the carton, where, in the reclosed configuration, the first and second top panels are interlocked by the locking tab of the second top panel being received in the slot of the first top panel and without being attached to each other by at least one adhesive area.

In one form, the slot in the first top panel has a perimeter with a linear portion and an arcuate portion. The slot may include two slits at opposite ends of the slot and extending away from intersections of the linear and arcuate portions of the slot. The at least one locking projection may include a first locking projection and a second locking projection. A maximum length of the slot as measured from an end point of a first of the linear slits to an end point of a second of the linear slits may be less than a maximum length of the closure tab as measured from an apex of the first locking projection to an apex of the second locking projection.

In one approach, a method of opening the carton includes moving the second top panel in a direction away from the first top panel to an intermediate open position to unobstruct the first top panel; and moving the first top panel in a direction away from the second top panel to unobstruct the access opening and permit access to the products in the interior of the carton.

By one approach, the moving of the second top panel in a direction away from the first top panel to an intermediate open position to unobstruct the first top panel may include pulling the handle in the direction away from the first top panel. In another approach, the moving of the second top panel in a direction away from the first top panel to an intermediate open position to unobstruct the first top panel may include detaching the second top panel from the first top panel along at least one adhesive area.

The moving of the second top panel in a direction away from the first top panel to an intermediate open position to unobstruct the first top panel may include raising the handle from a first position, where the handle is in one plane with the second top panel to a second position, where the handle is perpendicular to the second top panel.

The moving of the second top panel in a direction away from the first top panel to an intermediate open position to unobstruct the first top panel may include moving the closure tab away from the slot in the first top panel.

BRIEF DESCRIPTION OF THE DRAWINGS

FIG. 5 is a similar view as in FIG. 4, but showing the second top panel being moved further away from the first top panel in a direction toward the open position;

FIG. 6 is a similar view as in FIGS. 4 and 5, but showing the second top panel being in the open position;

DETAILED DESCRIPTION OF THE DRAWINGS

The cartons described herein may optionally be formed from a single blank and include an integrated handle for carrying the carton along with a locking tab that permits reclosure of the carton after the carton is initially opened. An exemplary carton 10 is shown in FIGS. 1-10 and an exemplary carton blank 100 that may be used to assemble the carton 10 is illustrated in FIG. 11.

Figure 7:
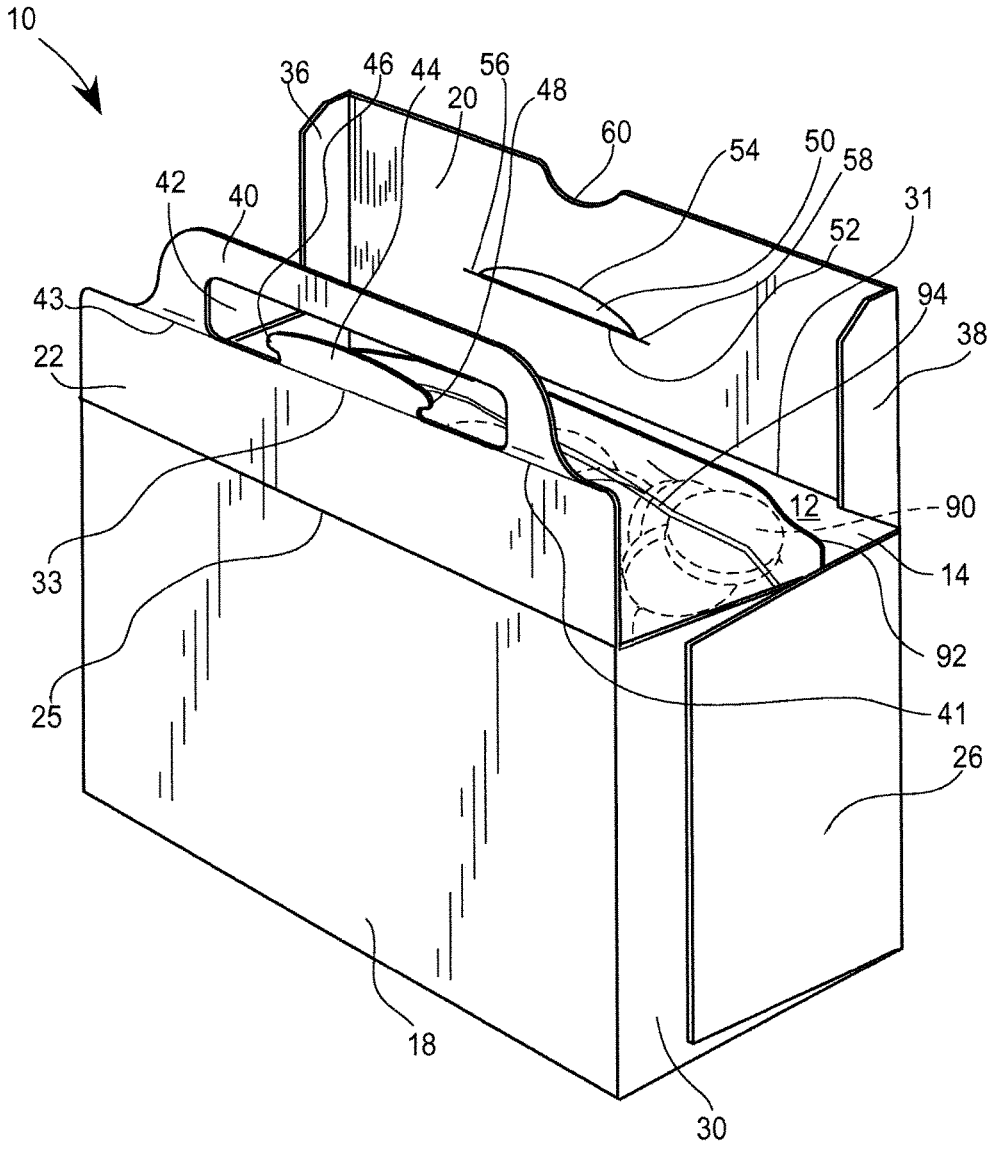
FIG. 7 is a perspective view of the carton of FIG. 1 being in the open configuration with both of the top panels in their open positions for access to a product-containing package in the interior of the carton.

The carton 10 includes an interior 12 configured to contain products 90, for example, cookies or crackers, which may be packaged together in a sealed (transparent or non-transparent) package 92 as shown in FIG. 7. The carton 10 has a top access opening 14 to the interior 12 that, when not obstructed by one or more panels of the carton 10, permits a user to access the products 90 in the interior 12 of the carton 10. The package 92 containing the products 90 may include a seam 94 that can be used to open the package 92, and the package 92 may be advantageously oriented in the carton 10 with the seam facing the access opening 14 and underlying the first and second top panels 20 and 22, such that when the carton 10 is opened as shown in FIG. 7, the seam 94 is visible to and faces the consumer. The products 90 have been shown in FIG. 7 as being in a single package 92 by way of example only, and it will be appreciated that the interior 12 of the carton 10 may store multiple packages containing one or more products, or may store products 90 that are individually wrapped or have no individual wrapper. The carton 10 may contain both food products and non-food products, and may contain food products other than cookies or crackers, some examples being candy, chocolates and the like.

Figure 1:
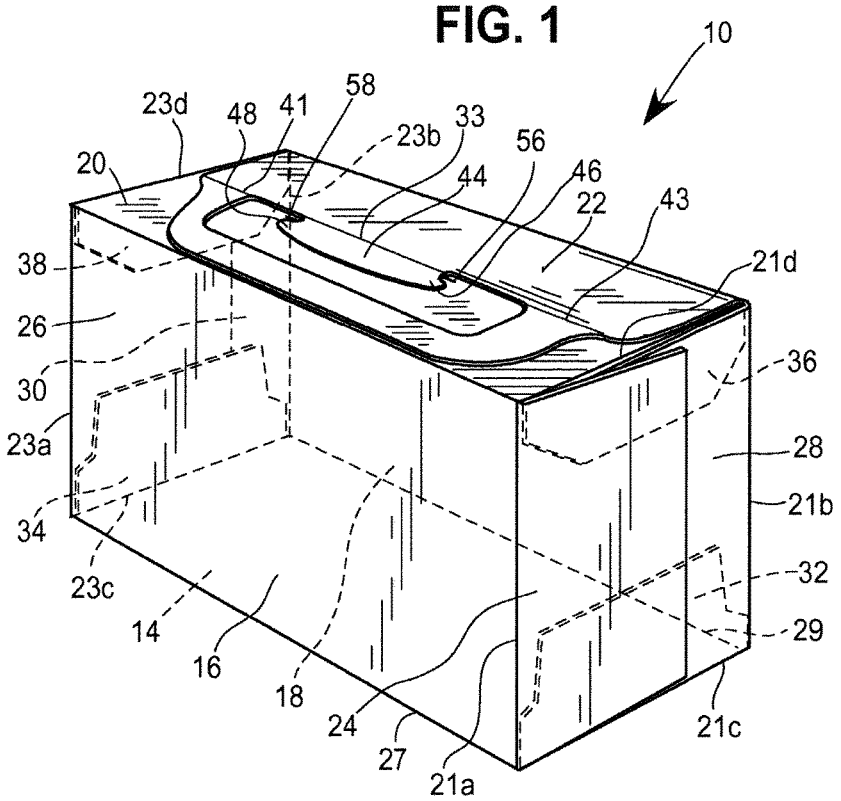
FIG. 1 is a perspective view of a carton being in a closed configuration where access to an interior is blocked by first and second top panels and a handle is in a stored position and showing inner structure in phantom line.

As shown in FIG. 1, the carton 10 includes first and second top panels 20 and 22. The carton 10 also includes a bottom flap or panel 14, a back (or rear) flap or panel, 18 and a front flap panel 16 opposite the back panel 18 as shown in FIG. 1. The flaps or panels of the exemplary carton 10 of FIG. 1 are interconnected as follows. The front and rear panels 16 and 18 are pivotally connected to the bottom panel 14 about creases or fold lines 27 and 29, respectively. Major or outer side panels 24 and 26 are pivotally connected to opposite sides of the front panel 16 about creases or fold lines 21*a* and 23*a*, respectively. Major or outer side panels 28 and 30 are pivotally connected to opposite sides of the rear panel 18 about creases or fold lines 21*b* and 23*b*, respectively. Minor or inner side panels 32 and 34 are pivotally connected to opposite sides of the bottom panel 14 about creases or fold lines 21*c* and 23*c*, respectively. Minor or inner side panels 36 and 38 are pivotally connected to opposite sides of the top panel 20 about creases or fold lines 21*d* and 23*d*, respectively.

As can be seen in FIG. 1, the minor bottom side panels 32 and 34 each extend upwardly from their adjacent fold lines or hinges 21*c* and 23*c*, respectively, while the minor top side panels 36 and 38 each extend downwardly from their adjacent fold lines or hinges 21*d* and 23*d*, respectively. The minor bottom side panel 32 extends in the interior 12 of the carton 10 along a portion of the major side panels 24 and 28. Similarly, the minor bottom side panel 34 extends in the interior 12 of the carton 10 along a portion of the major side panels 26 and 30. The minor top side panel 36 extends through the access opening of the carton 10 and in the interior 12 of the carton 10 along a portion of the major side panels 24 and 28. Similarly, the minor top side panel 38 extends through the access opening of the carton 10 and in the interior 12 of the carton 10 along a portion of the major side panels 26 and 30.

While the carton 10 has been illustrated in the accompanying Figures as including minor top and bottom side panels 32, 34, 36, and 38, it will be appreciated that the minor top and bottom side panels 32, 34, 36, and 38 are optional and the carton 10 may be assembled from a carton blank not having panels equivalent to the panels 32, 34, 36, and 38 to a closed configuration shown in FIG. 1. In addition, the relative dimensions and positions of the panels 24, 26, 28, and 30 have been shown in FIG. 1 by way of example only. For example, instead of the panels 24 and 26 overlapping portions of the panels 28 and 30, respectively, the carton 10 may be assembled such that the panels 28 and 30 overlap portions of the panels 24 and 26. In addition, instead of extending only across a part of the distance between fold lines 21*a* and 21*b* as shown in FIG. 1, the panel 24 may extend from the fold line 21*a* to the fold line 21*b*. Similarly, instead of extending only across a part of the distance between fold lines 21*a* and 21*b*, the panel 28 may extend from the fold line 21*b* to the fold line 21*a*. In addition, it will be appreciated that instead of having two overlapping panels 24, 28 closing one side of the carton 10 and two overlapping panels 26 and 30 closing another side of the carton 10, the carton 10 may be optionally constructed with only one panel closing each side of the carton 10.

With the carton 10 being in the closed configuration shown in FIG. 1, the panels 16, 18, 24, 26, 28, 30, 32, 34, 36, and 38 of the carton 10 are oriented generally vertically and substantially parallel to each other and substantially perpendicularly both relative to the horizontally-oriented bottom panel 14 and the horizontally-oriented first and second top panels 20 and 22. The panels 14, 16, 18, 20, 24, 26, 28, and 30 of the carton 10 are illustrated in FIGS. 1 and 11 as being generally rectangular, but it will be appreciated that one or more of the panels 14, 16, 18, 20, 24, 26, 28, and 30 may be trapezoidal, triangular, or of any other suitable shape.

When the carton 10 is in the closed configuration of FIG. 1, the minor bottom side panel 32 and the minor top side panel 36 may abut interior-facing surfaces of the major side panels 24 and 28. Similarly, the minor bottom side panel 34 and the minor top side panel 36 may abut interior-facing surfaces of the major side 6 and 30. For purposes of this application, the term "abut" means that physical contact is present between adjacent exterior-facing surfaces of the side panels 32, 34, 36, and 38 and the interior-facing surfaces of the side panels 24, 26, 28, and 30, respectively. It will be appreciated that optionally, the adjacent exterior-facing surfaces of the side panels 32, 34, 36, and 38 and the interior-facing surfaces of the side panels 24, 26, 28, and 30, respectively may be spaced apart and not in direct contact.

Figure 2:
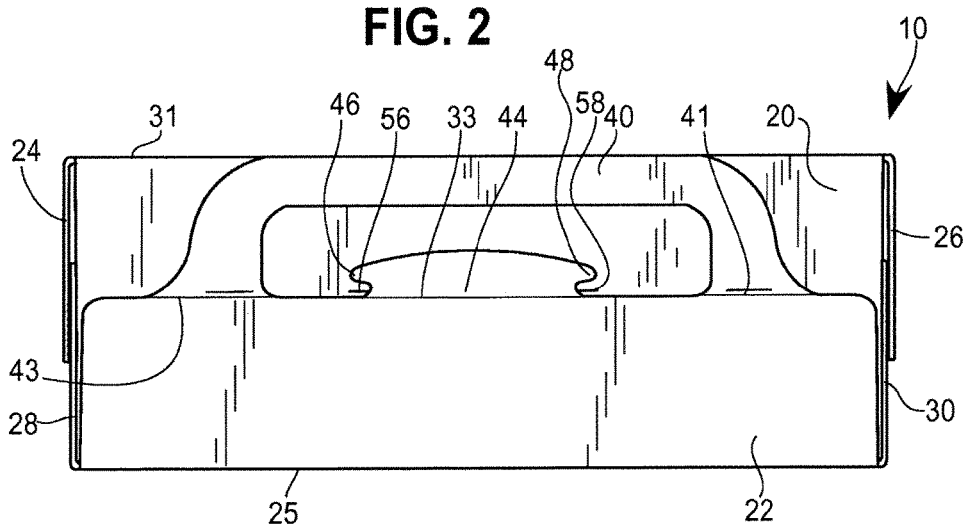
FIG. 2 is a top plan view of the carton of FIG. 1.

When the carton 10 is in the closed configuration of FIG. 1, the major outer side panel 24 overlies a portion of the major outer side panel 28. In addition, one or more portions of an interior-facing surface of the major outer side panel 24 are non-detachably attached to one or more corresponding portions of an exterior-facing surface of the major outer side panel 28 by means of a suitable adhesive to provide for a secure attachment of the major outer side panels 24 and 28 to each other as shown in FIGS. 1 and 2.

The major outer side panel 26 overlies a portion of the major outer side panel 30. One or more portions of an interior-facing surface of the major outer side panel 26 are non-detachably attached to one or more corresponding portions of an exterior-facing surface of the major outer side panel 30 by means of a suitable adhesive to provide for a secure attachment of the major outer side panels 26 and 30 to each other as shown in FIGS. 1 and 2. For purposes of this disclosure, "non-detachable" means an attachment that is not meant to be detached during normal use of the carton 10.

It will be appreciated that instead of having two top panels 20 and 22, the carton 10 may optionally include only one top panel that may be movable to obstruct and unobstruct the access opening 14 of the carton 10. When the carton 10 is in the closed configuration of FIG. 1, a second top panel 22 overlies a portion of the first top panel 20. In addition, one or more portions an interior-facing surface of the second top panel 22 may be detachably attached to one or more corresponding portions of the first top panel 20 by means of a suitable adhesive to provide for a secure but detachable attachment of the first and second top panels 20 and 22 to each other.

As used herein, "detachable" means an attachment that is meant to be detached during normal use of the carton 10. For example, the exterior-facing surface of the first top panel 20 may include adhesive portions 62 and 64 detachably attached to opposing complementary non-adhesive portions 66 and 68 of the interior-facing surface of the second top panel 22. Alternatively, each of portions 62, 64, 66, and 68 in FIGS. 5 and 6 may include a suitable adhesive such that the first and second top panels 20 and 22 may be detachably attached to each other via an adhesive-to-adhesive attachment.

In one optional form, the adhesive areas 62 and 64 on the first top panel 20 may be surrounded by lines of weakness 70 and 72 that would permit the adhesive areas 62 and 64 to be separated from adjacent portions of the first top panel 20 along their respective lines of weakness 70 and 72 during movement of the second top panel 22 in a direction away from the first top panel 20 as the carton 10 is being opened by a consumer.

The lines of weakness 70 and 72 may be perforations or score lines, which can be formed by laser ablation, die-cutting, micro-abrasion, or the like. While the adhesive areas 62 and 64 and the optional lines of weakness 70 and 72 are illustrated as being on the first top panel 20 only, it will be appreciated that areas 66 and 68 of the second top panel 22 also may include adhesive material and the areas 66 and 68 of the second top panel 22 also may be surrounded by lines of weakness. For a multi ply material, the lines of weakness 70 and 72 can extend into or through an outer ply to facilitate delamination of the plies during opening.

The second top panel 22 includes an integrally formed handle 40 as shown in FIGS. 1 and 2. The handle 40 extends along and at least partially surrounds and defines an opening 42 configured to permit a user of the carton to pass the user's fingers and/or hand portion therethrough such that the user may grasp the handle 40 and carry the carton 10 while holding the handle 40. As discussed in more detail below, the handle 40 is formed together with the second top panel 22 from the carton blank 100 and is pivotally connected to and movable relative to the second top panel 22 by pivoting about creases or fold lines 41 and 43.

Figure 3:
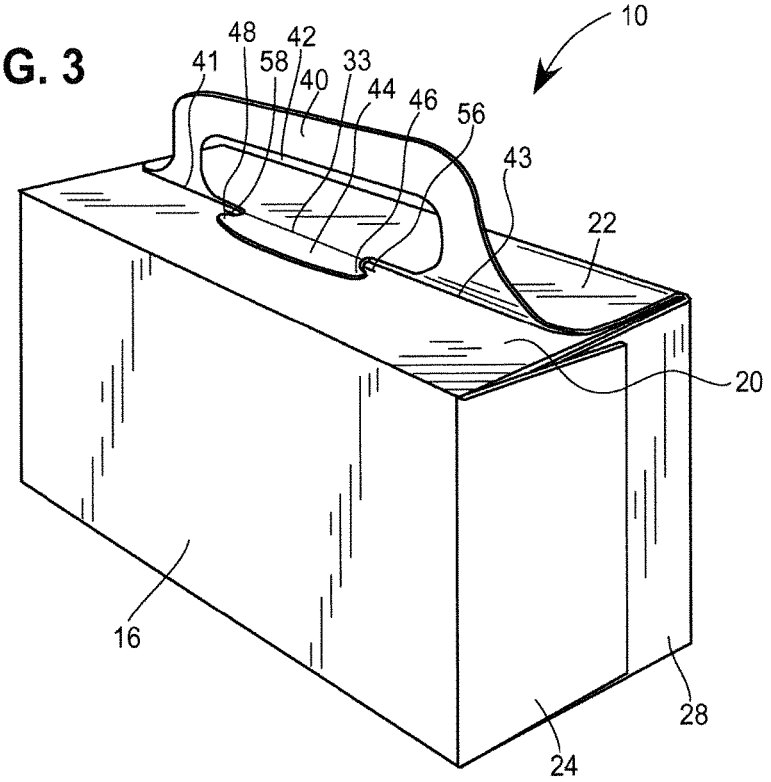
FIG. 3 is a perspective view of the carton of FIG. 1 being in a closed configuration but with the handle in a raised position that permits a user to carry the carton using the handle.

As seen in FIGS. 1, 2, and 6, the second top panel 22 includes a closure tab 44 integrally formed with, and projecting from the second top panel 22 into the opening 42 and toward the handle 40 when the closure tab 44 is coplanar with the handle 40. The closure tab 44 is hingedly connected to the second top panel 22 along a crease line or fold line 33 as shown in FIGS. 2 and 3 and is movable relative to the second top panel 22 and relative to the handle 40 about the crease or fold line 33, for example, when the closure tab 44 is being used to reclose the carton 10, as shown, for example, in FIG. 8.

Figure 8:
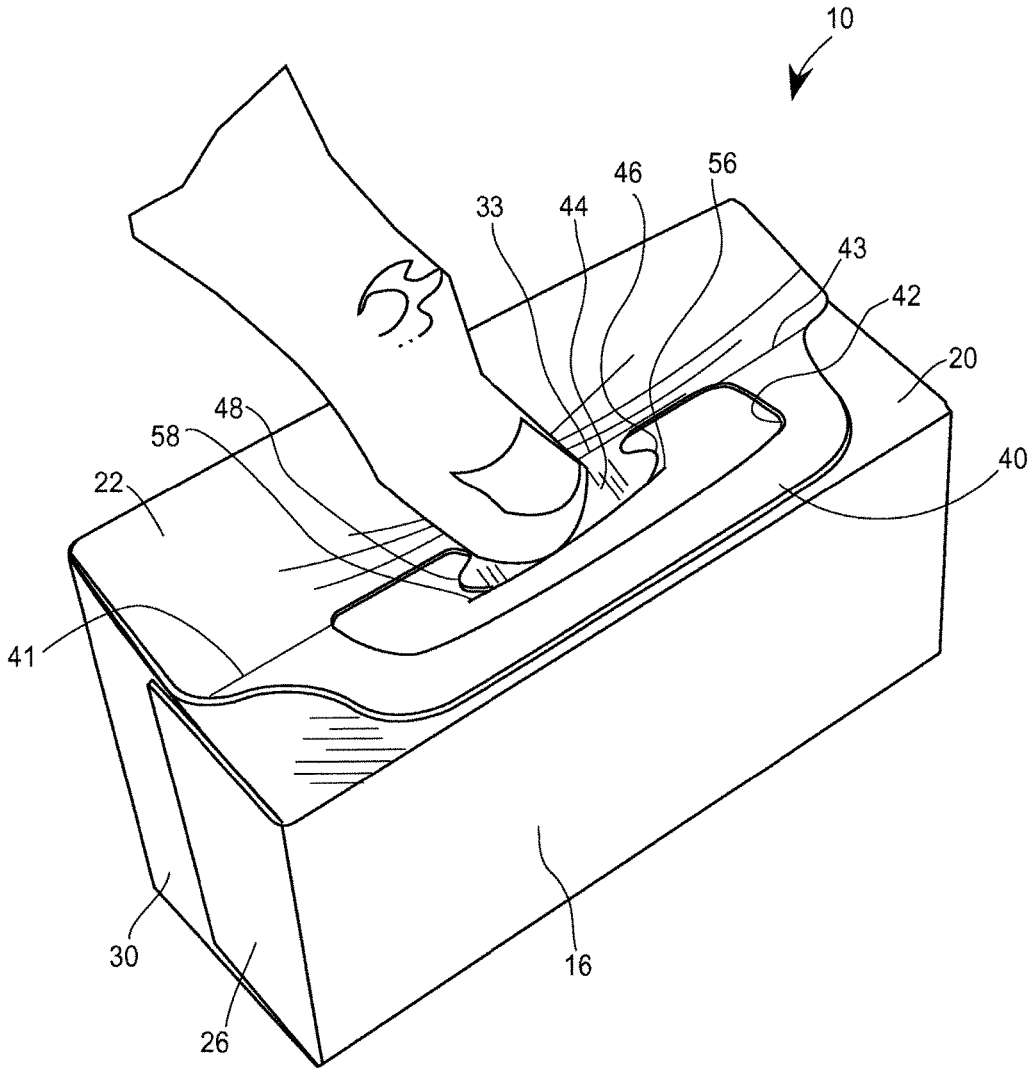
FIG. 8 is a top perspective view of the carton of FIG. 1 being reclosed by a consumer after the initial opening, showing a consumer's finger pressing down on the closure tab of the second top panel to insert the closure tab into the receiving opening of the first top panel.
Figure 9A:
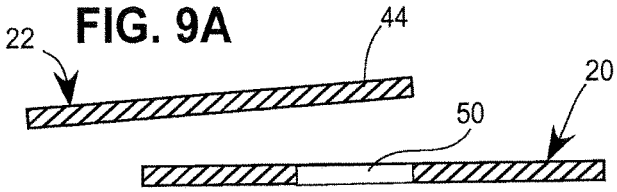
FIGS. 9A-9E illustrate fragmentary enlarged sectional views of the movement of the first and second top panels as the closure tab of the second top panel is inserted into the receiving opening of the first panel during reclosure of the carton.
Figure 9B:
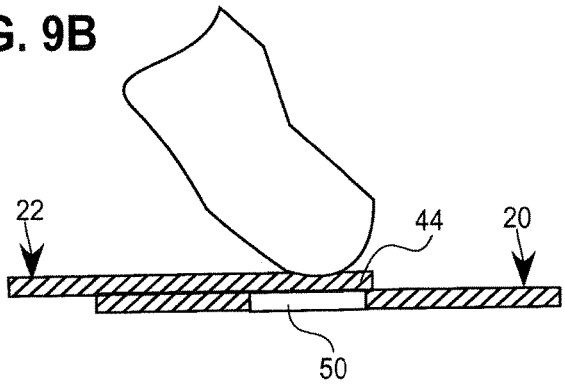
Figure 9C:
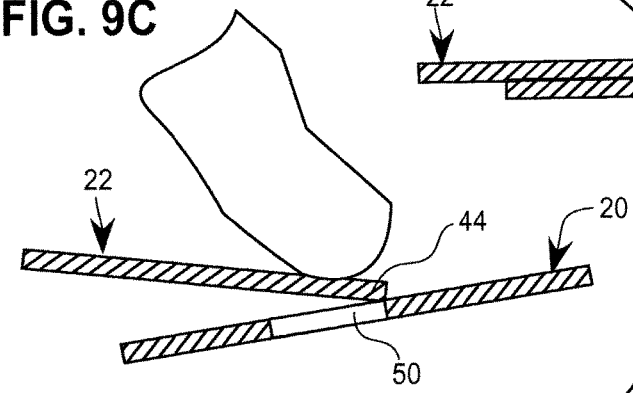
Figure 9D:
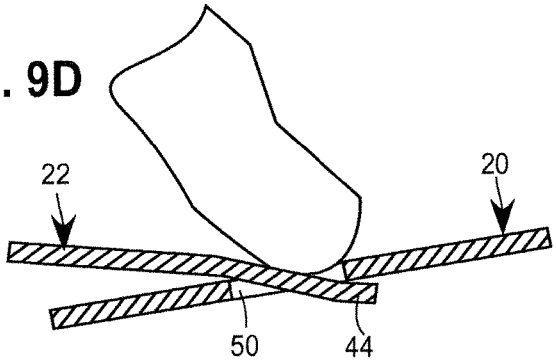
Figure 9E:
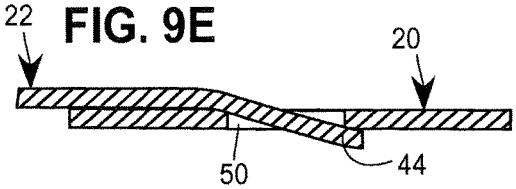
Figure 10:
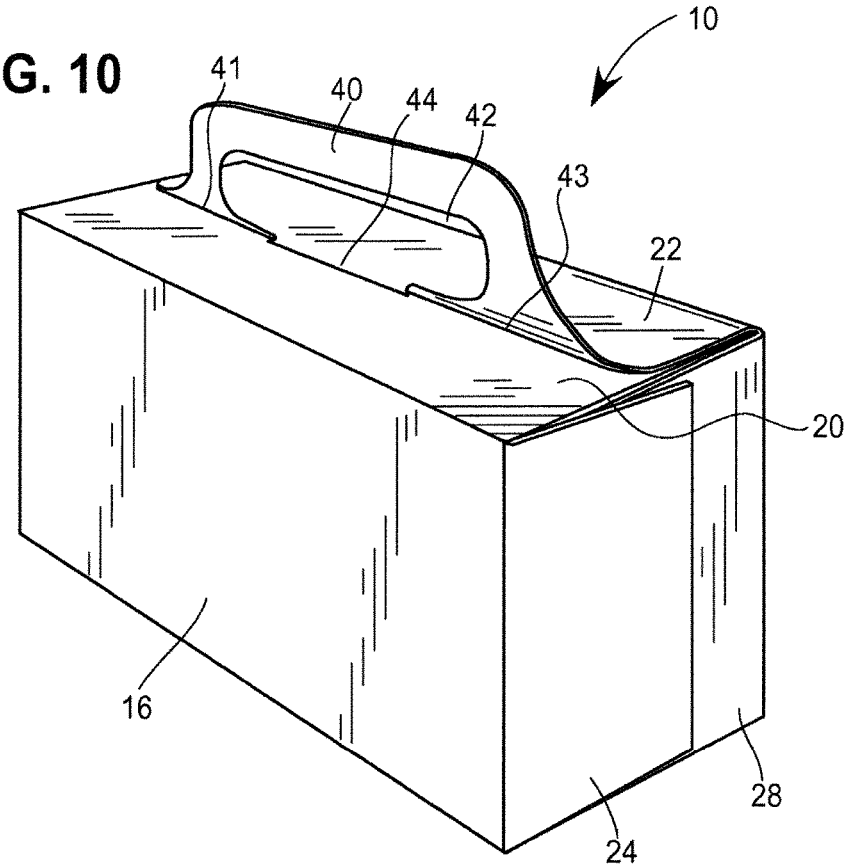
FIG. 10 is a perspective view of the carton of FIG. 1 being in a reclosed configuration with the closure tab being inserted into the receiving slot and the handle in a raised position that permits a user to carry the reclosed carton using the handle.
Figure 11:
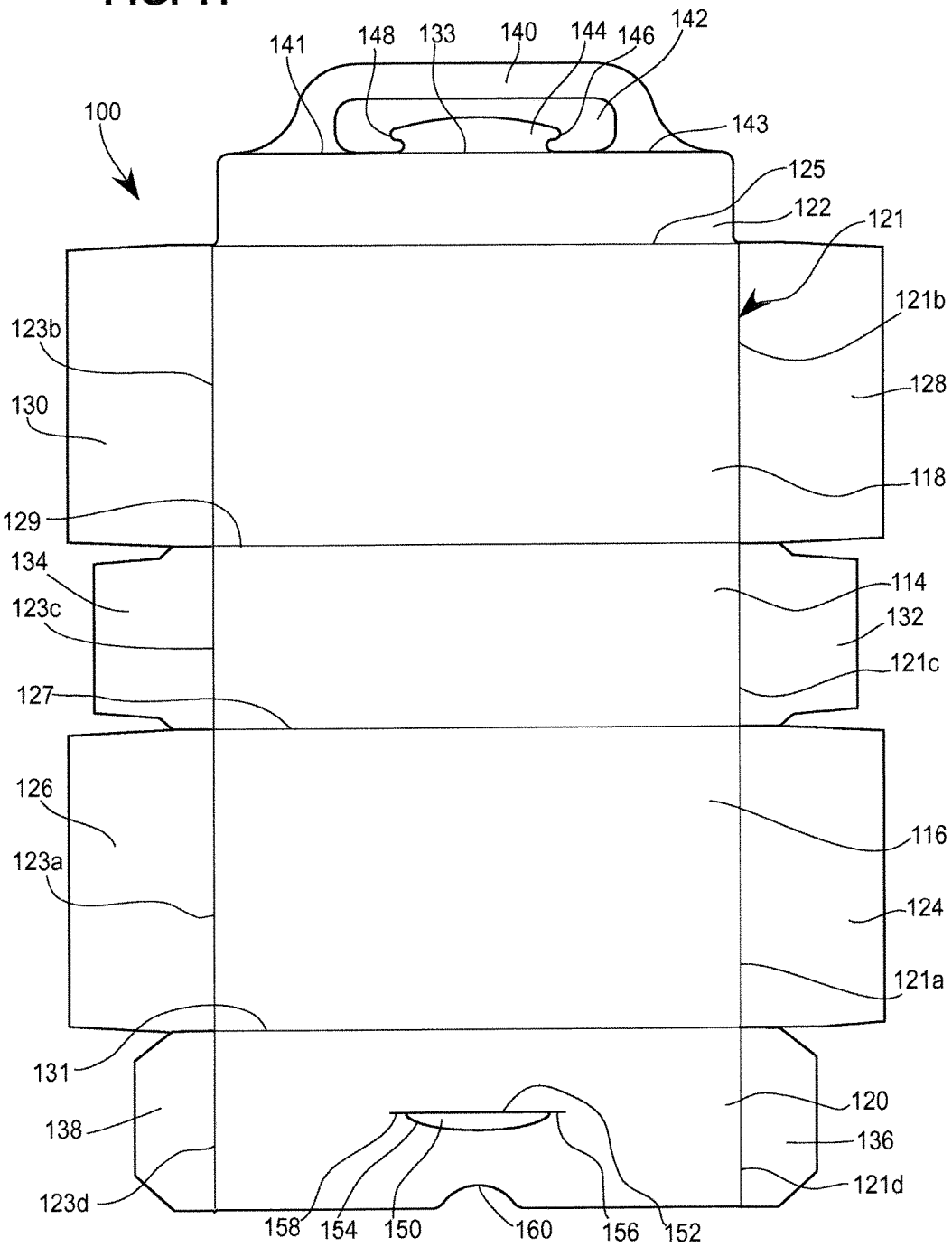
FIG. 11 is a top plan view of an exemplary blank foldable to assemble the carton of FIG. 1.

As seen, for example, in FIG. 5, the first top panel 20 includes an opening 50 configured by having a size and shape to receive the closure tab 44, for example, when the carton 10 is being reclosed as shown in FIG. 8, and when the carton is in a reclosed configuration as shown in FIG. 10. In one approach illustrated in FIG. 1, when the carton 10 is in the closed (unopened) configuration, the closure tab 44 is not inserted into the opening 50 and is positioned to overlay the opening 50 and portions of the first top panel 20. When so positioned, the closure tab 44 is oriented in one plane with the second top panel 22 and substantially parallel to the first top panel 20. It will be appreciated that instead of being positioned to overlay the opening 50 of the first top panel 20 as shown in FIG. 1, the closure tab 44 may be inserted into the opening 50 of the first top panel 20 to interlock the first and second top panels 20 and 22 to each other when the carton 10 is in the closed (unopened) configuration.

The closure tab 44 may include one or more portions shaped in the form of a locking projection extending from the closure tab 44 to facilitate a secure interlock between the first and second top panels 20 and 22 of the carton 10. For example, the closure tab 44 may be shaped to advantageously include opposed locking projections 46 and 48 as shown, for example in FIG. 7. While the locking projections 46 and 48 of the closure tab 44 have been shown in FIG. 7 as being generally rounded and having a hook-like form, it will be appreciated that the locking projections 46 and 48 may be linear (e.g., generally pointed or triangular), and may be, for example, in the shape of a barb, a spike, or the like. While FIG. 7 illustrates the closure tab 44 being formed with two opposed locking projections 46 and 48, it will be appreciated that the closure tab 44 may include only one locking projection extending therefrom, or more than two (e.g., three, four, or more) locking projections extending therefrom.

The opening 50 in the first top panel 20 has a perimeter with a linear portion 52 and an arcuate portion 54. Linear slits 56 and 58 extend away from respective intersections of the linear and arcuate portions 52 and 54 of the opening 50, as shown, for example, in FIGS. 5 and 6. The opening 50 is sized and positioned such that, when the closure tab 44 passes through the receiving opening 50, for example, when the carton 10 is being reclosed as shown in FIG. 8 after being opened for the first time, the first locking projection 46 passes through the slit 56 while the second locking projection 48 passes through the slit 58.

When the carton 10 is in a closed (i.e., unopened configuration) of FIG. 1, the first and second top panels 20 and 22 are attached to each other via the adhesive areas 62 and 64 as described above and are oriented substantially parallel to each other and substantially perpendicular to the front and rear panels 16 and 18, respectively, such that the access opening 12 (see of the carton 10 (shown in FIG. 7) is obstructed and access to the products 90 in the interior 12 of the carton 10 is not permitted. Conversely, when the carton 10 is in an open configuration shown in FIG. 7, the first and second top panels and 22 are detached from each other and oriented substantially parallel to each other and substantially planar with the front and rear panels 16 and 18 such that the access opening 12 is unobstructed, and the products 90 in the interior are visible to the consumer and may be accessed (i.e., removed from the interior 12 of the carton 10) by the consumer.

The attachment of the first and second top panels 20 and 22 to each other via the adhesive areas 62 and 64 restricts the second top panel 22 from inadvertently detaching from the first top panel 22 and opening during transportation of the carton 10 to a retail location or during carrying of the carton 10 by a user while holding the handle 40. As discussed above, when the carton 10 is in the closed (unopened) configuration, the closure tab 44 may be not inserted into the opening 50 of the first top panel 20, but positioned to overlay the opening 50, as shown in FIG. 1, or may be inserted into the opening 50 of the first top panel 20 to provide an additional interlock between the first and second top panels 20 and 22. In other words, the first and second top panels 20 and 22 can be securely attached to each other via the adhesive areas 62 and 64 to keep the carton 10 closed in the unopened configuration of FIG. 1 and an additional interlock provided by the closure tab 44 and the opening 50 is not required to keep the carton 10 closed prior to being first opened by a user.

The closed configuration of the carton 10 in FIG. 1 is advantageously compact for shipping the carton 10. For example, to facilitate the stacking of multiple cartons 10 on top of one another during transportation of the cartons 10 to retail locations and/or display of the cartons 10 on shelves at retail locations, the handle 40 may be positioned in a stored (or horizontal) position, where the handle 40 is positioned in one plane with both the second top panel 22 and the closure tab 44 such that the handle 40 is substantially parallel to and abuts the first top panel 20 as shown in FIGS. 1 and 2.

Conversely, to facilitate the carrying of the carton 10 by a consumer when in use, the handle 40 may be moved to a deployed (or vertical) position, where the handle 40 is positioned substantially perpendicularly to the first and second top panels 20 and 22 and to the closure tab 44, and the user is permitted to insert the user's fingers through the opening 42 and to grasp the handle 40 for carrying the carton 10.

The carton 10 may be opened by a user either when the carton 10 is in the closed position with the handle 40 being in the stored position as shown in FIG. 1, or when the carton 10 is in the closed position with the handle 40 being in the deployed position as shown in FIG. 3. In particular, the carton 10 may be opened by a user by applying a force (e.g., using the user's fingers) to move the second top panel 22 about a hinge provided by the fold line 25 in a direction away from the first top panel 20 as shown by the directional arrows in FIG. 4. For example, a user may grasp the handle 40 and pull the handle 40 in a direction away from the first top panel 20 to detach the second top panel 22 from the top panel 20. The simplicity of opening the carton 10 by simply pulling on the handle 40 is advantageous for users such as young children. Instead of pulling on the handle 40 to open the carton 10, the user may apply a force using one or more fingers to other portions of the second top panel 22 to push or pull the second panel 22 in a direction away from the first top panel 20 and open the carton 10.

Figure 4:
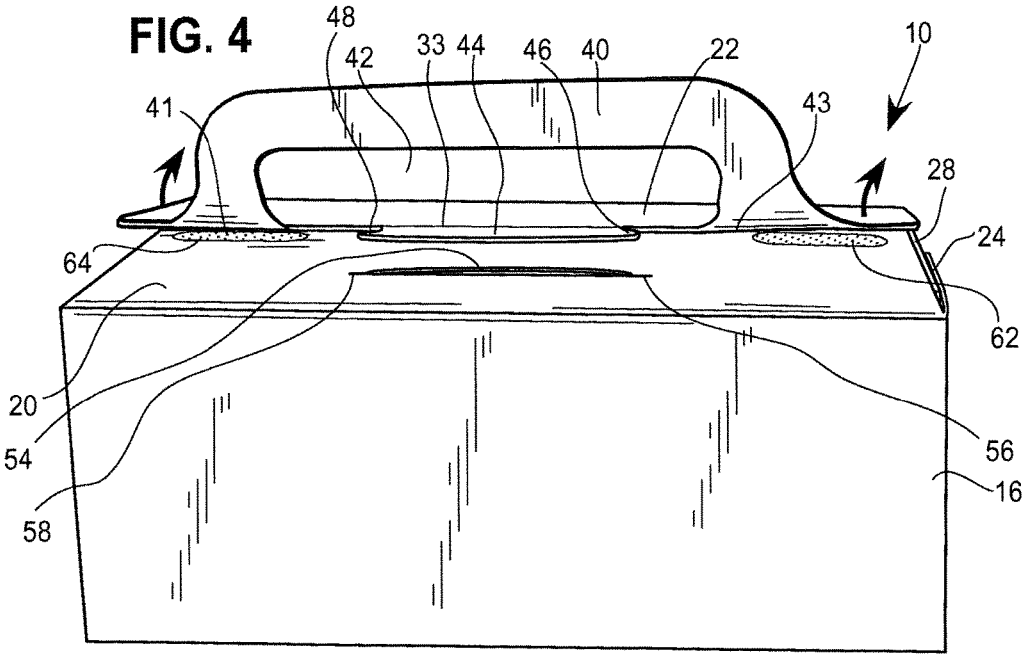
FIG. 4 is a front perspective view of the carton of FIG. 1, showing a second of the top panels being moved toward an open position, the detachment of the first and second panels at adhesive areas therebetween and a closure tab being partially removed from a receiving opening of the first top panel.

During the opening of the carton 10, as the second top panel 22 is being urged in a direction shown by the arrows in FIGS. 4 and 5 away from the first top panel 20, the opening force and tension being applied by the user overcomes the adhesion of the first and second panels 22 provided by the adhesive areas 62 and 64, and causes the second top panel 22 to separate from the first top panel 22. As the second top panel 22 of the carton 10 is moved from the position shown in FIG. 3 to a position shown in FIG. 6, the closure tab 44, which is formed integrally with the second top panel 22, also moves in a direction away from both the first top panel 20 and the receiving opening 50, and the second top panel 22 moves out of contact with the first top panel 20, such that the adhesive areas 62 and 64 are no longer in contact with the opposite complementary areas 66 and 68, as shown in FIGS. 4 and 5.

In the exemplary position shown in FIG. 5, the interior-facing surface of the top panel 22 is positioned at an angle of less than 90 degrees relative to the exterior-facing surface of the first top panel 20 and a portion of the second top panel 22. In particular, portions of the interior-facing surface of the top panel 22 and portions of the closure tab 44 overlie portions of the first top panel 20 and restrict movement of the first top panel 20 to the fully open position of the carton 10.

As the second top panel 22 is moved away from the first top panel 22 from the position shown in FIG. 3 toward the intermediate open position of FIG. 6, portions 66 and 68 of the interior-facing surface of the second top panel 22 that were in contact with the adhesive areas 62 and 64 of the first top panel may be torn away from adjacent portions of the interior-facing surface of the first top panel 20, as shown in FIGS. 5-6. As a result, the adhesive areas 62 and 64 may become covered by the material torn off from the areas 66 and 68 of the interior-facing surface of the second top panel 22, and the adhesive areas 62 and 64 no longer provide for adhesion of the first and second top panels 20 and 22 to each other.

The adhesive areas 62 and 64 thus provide a freshness seal and/or tamper-evident feature for the carton 10 such that the absence of adhesion areas 62 and 64, or the presence of non-adhesive materials on the adhesive areas 62 and 64 would visually indicate to a consumer that the carton 10 has been previously opened or tampered with. In addition, since a user would feel some resistance during the detachment of the second top panel 22 from the first top panel 22 along the adhesive areas 62 and 64, the adhesive areas 62 and 64 can provide a tactile and potentially audible response to the user during an initial opening of the carton 10.

With the carton 10 being in the first intermediate position shown in FIG. 6, the second top panel 22 is oriented such that the interior-facing surface of the second panel 22 is substantially perpendicular to the exterior-facing surface of the first top panel 20, and the second panel 22 is substantially planar with the rear panel 18 of the carton 10 and does not overlie the first top panel 20, or restrict the first top panel 20 from being moved toward the fully opened position. It will be appreciated that the position of the second top panel 22 is shown by way of example only, and the second top panel 22 may be moved past the position shown in FIG. 6.

For example, the second top panel 22 may be moved about the hinge provided by the fold line 25 from the initial position shown in FIG. 1 by a range of motion of about 180 degrees to a position where the second top panel 22 is substantially parallel to the first top panel 20 and perpendicular to the rear panel 18. The second top panel 22 may likewise move about the hinge provided by the fold line 25 from the initial position shown in FIG. 1 by a range of motion of about 270 degrees to a position where the second top panel 22 is substantially perpendicular to the first top panel 20 and parallel to the rear panel 18.

With the carton 10 being in the first intermediate position shown in FIG. 6, a user may place a finger in the cutout area 60 of the first top panel 20 and move the first top panel 20 about the hinge provided by the fold line 31 in a direction away from the access opening 14 and the second top panel 22 and to a fully open position shown in FIG. 7. The cutout area 60 of the first top panel 20 thus facilitates the opening of the first top panel 20 from the first intermediate position of FIG. 6 to the fully open position of FIG. 7.

With the carton 10 being in the fully open position shown in FIG. 7, the second top panel 22 is substantially planar with the rear panel 18 of the carton 10 and the first top panel is substantially planar with the front panel 16 of the carton, and the first and second top panels 20 and 22 are substantially parallel to each other, and the interior-facing surfaces of the first and second top panels 20 and 22 do not overlie and/or obstruct the access opening 14 of the carton 10 and permit the products 90 to be removed from the interior 12 of the carton 10 through the access opening 14. It will be appreciated that the first top panel 20, like the second top panel 22, may be moved more than 90 degrees from the initial position shown in FIG. 1. For example, the first top panel may be moved about the hinge provided by the fold line 31 from the initial position shown in FIG. 1 by a range of motion of up to about 270 degrees.

After a user opens the carton 10 for the first time as described above, if the user consumes only a portion of the products 90 and desires to reclose the carton 10 to safely retain the remaining products 90 in the carton 10, the carton 10 may be securely reclosed using the closure tab 44 as described below. In particular, to reclose the carton 10 from the fully open position of FIG. 7 to the reclosed position of FIG. 10, a consumer may initially move the first top panel 20 about the hinge provided by the fold line 31 from the position shown in FIG. 7 such that minor top flaps 36 and 38 of the first top panel 20 pass through the access opening 14 and into the interior 12 of the carton 10 until the first top panel 20 arrives to the position shown in FIG. 6. The consumer may then move the second top panel 22 about the hinge provided by the fold line 25 from the position shown in FIG. 7 to bring the second top panel 22 toward the first top panel 20 and the closure tab 44 toward the receiving opening 50 as shown FIG. 8.

In order to interlock the first and second top panels 20 and 22 and reclose the carton 10, the consumer may apply a force (e.g., by pushing with a finger) to the closure tab 44 as shown in FIG. 8 to force the closure tab 44 into the receiving opening 50 of the first top panel 20. The force applied by the user's finger in FIG. 8 may be sufficient to slightly deform the closure tab 44 in order to permit the locking projections 46 and of the closure tab 44 to slide into the opening 50 and through the slits 56 and 58, and to form a secure interlock with portions of the first top panel 20 adjacent the slits 56 and 58, thereby restricting the first and second top panels 20 and 22 from being inadvertently opened, for example, in response to typical forces applied to the carton 10 when the consumer carries the carton 10 by holding the handle 40. As discussed above, while the closure tab 44 is shown in FIG. 8 as having two locking projections 46 and 48, the closure tab 44 may include only one locking projection or three or more locking projections that facilitate a secure interlock between the first and second top panels 20 and 22.

The arcuate portion 54 of the opening 50 advantageously permits the closure tab 44 to be deformed enough to permit the locking projections 46 and 48 of the closure tab to be inserted into the slits 56 and 58 of the receiving opening 50 and can act to limit or otherwise control formation. FIGS. 9A-9E schematically show how the application of a force by a finger of a user results in the insertion of the closure tab 44 of the second top panel 22 into the receiving opening 50 of the first top panel 20.

FIG. 10 shows the carton 10 in a reclosed position, with the locking tab 44 providing a secure interlocking attachment of the second top panel 22 to the first top panel 20 even without the adhesive-based attachment between the first and second panels 20 and 22 initially provided by the adhesive areas 62 and 64 when the carton 10 is in an unopened configuration. The locking projections 46 and 48 of the closure tab 44 advantageously resist inadvertent sliding of the locking tab 44 out of the opening 50 in response to the carton 10 being carried by the handle 40 during normal use and thus provide a secure interlock with portions of the first top panel 20 adjacent the slits 56 and 58 without the use of an adhesive.

It will be appreciated that instead of being partially linear and partially arcuate, the receiving opening 50 may lack the arcuate portion 54 and may have an entirely linear perimeter. In addition, it will be appreciated that while the presence of the slits 56 and 58 may facilitate the insertion of the locking projections 46 and 48 of the closure tab 44 into the receiving opening 50, the slits 56 and 58 are optional and the closure tab 44 may be inserted into the receiving opening 50 even if the slits 56 and 58 were absent.

An exemplary method of manufacturing the carton 10 is described with reference FIG. 11. The method of manufacture is generally depicted in FIG. 11 by illustrating the orientation and manipulation of a carton blank 100 from which the carton 10 is made without showing the accompanying assembly line machinery. Turning now to more details regarding the construction of the carton 10, the exemplary carton 10 may be advantageously made from a single carton blank 100, which is shown in FIG. 11. The blank 100 may be formed of paperboard, cardboard or the like, with a thickness determined based upon the weight and durability requirements of the carton 10. The carton blank material can be unwound from a feed roll and fed as a web in a machine direction, for example, on top of a stationary plate, along a moving conveyor, or the like. The exemplary carton blank 100 is shown in FIG. 11 with pre-formed creases/fold lines, but it will be appreciated that the carton blank 100 may not have pre-formed creases/fold lines, and that the creases/fold lines as shown in FIG. 11 may be formed as a result of the folding of various portions of the carton blank 100 during assembly of the carton 10 from the carton blank 100.

The exemplary blank 100 illustrated in FIG. 11 has two longitudinal fold lines 121 and 123 that are parallel to each other and four transverse fold lines 125, 127 129, and 131 that are parallel to each other and transverse to the longitudinal fold lines 121 and 123. While the fold lines 121 and 123 have been shown in FIG. 11 as parallel to each other and the fold lines 125, 127, 129, and 131 have been shown as being parallel to one another and perpendicular to the fold lines 121 and 123, it will be appreciated that the fold lines 121 and 123 may be non-parallel, that one or more of the fold lines 125, 127, 129, and 131 may be non-parallel, and that one of more of the fold lines 125, 127, 129, and 131 may be non-parallel to the fold lines 121 and 123. In addition, while the fold lines 121, 123, 125, 127, 129, and 131 have been shown in FIG. 11 as being linear, one or more of the 121, 123, 125, 127, 129, and 131 may be non-linear or in a form of a folded area of the carton blank 100 instead of a single line.

As discussed in more detail below, with the carton blank 100 positioned as shown in FIG. 11, the carton blank 100 may be sequentially folded about multiple fold lines to assemble the carton 10 in the closed configuration shown in FIG. 1. Adhesive material may be applied to one or more portions of the carton blank 100 as discussed below to facilitate detachable and/or non-detachable attachment of portions of the carton blank 100 to one another. For ease of reference, aspects of the carton blank 100 that are similar to aspects of the carton 10 have been designated with similar reference numbers, but prefaced with a "1."

With reference to FIG. 11, panel 114 of the carton blank 100 forms the bottom panel 14 of the assembled carton 10 of FIG. 1. In the embodiment shown in FIG. 11, the panel 114 of the carton blank 100 includes a side flap or panel 132 hingedly connected to the panel 114 along a fold line 121*c*, and a another side flap or panel 134 hingedly connected to the panel 114 along a fold line 123*c*. The side panels 132 and 134 are movable relative to the bottom panel 114, for example, during assembly of the carton 10 from the blank 100, by pivoting about the fold lines 121*c* and 123*c*, respectively. As discussed above, the fold lines 121*c* and 123*c* may be pre-formed, or formed as a result of the pivoting of the side panels 132 and 134. The panel 132 forms a minor bottom side panel 32 of the assembled carton 10 and the panel 134 forms a minor bottom side panel 34 of the assembled carton 10.

The blank 100 further includes panels 116 and 118, which form the front and rear panels 16 and 18, respectively, of the assembled carton 10. The panel 116 is hingedly connected to the panel 114 along a fold line 127 and is movable relative to the panel 114, for example, during assembly of the carton 10 from the blank 100, by pivoting about the fold line 127, which may be pre-formed, or formed as a result of the pivoting of the panel 116. Similarly, the panel 118 is hingedly connected to the panel 114 along a fold line 129 and is movable relative to the panel 114, for example, during assembly of the carton 10 from the blank 100, by pivoting about the fold line 129, which may be pre-formed, or formed as a result of the pivoting of the panel 118.

In the embodiment shown in FIG. 11, the panel 116 of the carton blank 100 includes a side flap or panel 124 hingedly connected to the panel 116 along a fold line 121*a* and another side flap or panel 126 hingedly connected to the panel 116 along another fold line 123*a*. The panels 124 and 126 are movable relative to the panel 116, for example, during assembly of the carton 10 from the blank 100, by pivoting about the fold lines 121*a* and 123*a*, respectively, which may be pre-formed, or formed as a result of the pivoting of the panels 124 and 126. In the illustrated embodiment, the panel 124 forms the major outer side panel 24 and the panel 126 forms the major outer side panel 26 of the assembled carton 10.

The panel 118 of the carton blank 100 includes a side flap or panel 128 hingedly connected to the panel 118 along the fold line 121*b* and a flap or panel 130 hingedly connected to the panel 118 along the fold line 123*b*. The panels 128 and 130 are movable relative to the panel 118, for example, during assembly of the carton 10 from the blank 100, by pivoting about the fold lines 121*b* and 123*b*, respectively, which may be pre-formed, or formed as a result of the pivoting of the panels 128 and 130. In the exemplary illustrated form, the panel 128 forms the major outer side panel 28 and the panel 130 forms the major outer side panel 30 of the assembled carton 10.

The carton blank 100 further includes a panel 120 that forms the first top panel 20 of the assembled carton 10, and a panel 122 that forms the second top panel 22 of the assembled carton 10. The panel 120 is hingedly connected to the panel 116 along a fold line 131 and is movable relative to the panel 116, for example, during assembly of the carton 10 from the blank 100, by pivoting about the fold line 131, which may be pre-formed, or formed as a result of the pivoting of the panel 120.

In the embodiment shown in FIG. 11, the panel 120 of the carton blank 100 includes a flap or panel 136 hingedly connected to the panel 120 along a fold line 121*d* and another side flap or panel 138 hingedly connected to the panel 120 along a fold line 123*d*. The panels 136 and 138 are movable relative to the panel 120, for example, during assembly of the carton 10 from the blank 100, by pivoting about the fold lines 121*d* and 123*d*, respectively, which may be pre-formed, or formed as a result of the pivoting of the panels 136 and 138. The panel 136 forms a minor top side panel 36 of the assembled carton 10 and the panel 134 forms the minor top side panel 38 of the assembled carton 10.

The carton blank 100 further includes a panel 122 that forms the second top panel 22 of the assembled carton 10. The panel 122 is hingedly connected to the panel 118 along a fold line 125 and is movable relative to the panel 118, for example, during assembly of the carton 10 from the blank 100, by pivoting about the fold line 125, which may be pre-formed, or formed as a result of the pivoting of the panel 122.

The carton blank 100 further includes a handle-shaped portion 140 that forms the handle 40 of the assembled carton 10. The handle-shaped portion 140 of the blank 100 is hingedly connected to the panel 122 about crease lines or fold lines 141 and 143, which may be pre-formed, or formed as a result of the pivoting of the handle-shaped portion 140. The handle-shaped portion 140 may pivotally move relative to the panel 122 about the fold lines 141 and 143, for example, when the handle 40 of the assembled carton 10 is moved from the stored position to the deployed position and from the deployed position back to the stored position. The handle-shaped portion 140 extends along and partially surrounds a cutout or opening 142 in the blank 100 that is sized and shaped to receive fingers of a user and/or a portion of the user's hand such that the user may grasp the handle 40 and carry the carton 10 while holding the handle 40.

The carton blank 100 also includes a closure tab-shaped portion 144 extending from the panel 122 into the opening 142 as shown in FIG. 11. The closure tab-shaped portion 144 forms the closure tab 44 of the assembled carton 10 and is hingedly connected to the panel 122 about a crease line or fold line 133 as shown in FIG. 11. The closure tab-shaped portion 144 is permitted to pivotally move relative to the panel 122 about the fold line 133, for example, when the closure tab 44 of the assembled carton 10 is being inserted into the receiving opening 50 during the reclosing of the carton 10, or when the closure tab 44 of the reclosed carton 10 is being inserted back out of the receiving opening 50 during a subsequent reopening of the carton 10. The closure tab-shaped portion 144 of the blank 100 includes two locking projections 146 and 148 that advantageously provide for secure reclosure of the carton 10 without a need for adhesive material to achieve reclosure of the carton 10 after initial opening of the carton 10.

As can be seen in FIG. 11, the panel 120 of the carton blank 100 includes a cutout, slot, or opening 150 sized and shaped to receive the closure tab-shaped portion 144. The opening 150 has a perimeter with a linear portion 152 and an arcuate portion 154. In the embodiment illustrated in FIG. 11, the arcuate portion 154 intersects the linear portion 152 at two locations. The distance from the first intersection of the linear portion 152 and the arcuate portion 154 to the second intersection of the linear portion 152 and the arcuate portion 154 is less than the maximum length of the tab-shaped portion 144 of the blank 100. Slits 156 and 158 extend away from respective intersections of the linear and arcuate portions 152 and 154 of the opening 150, as shown in FIG. 11. The distance from the end point of the slit 156 to the end point of the slit 158 may be equal to, slightly larger, or slightly smaller than the maximum length of the tab-shaped portion 144.

The opening 150 is sized and positioned on the carton blank 100 such that, when the closure tab-shaped portion 144 passes through the receiving opening 150 as when the assembled carton 10 is reclosed, the projection 146 passes through the slit 156 while the projection 148 passes through the slit 158. The closure tab-shaped portion 144 may pass through the opening 150 and the slits 156 and 158 without any portion of the tab-shaped portion 144 deforming, or with a portion the closure tab-portion 144 slightly deforming to permit the locking projections 146 and 148 to fit through the slits 156 and 158, respectively.

In one exemplary form shown in FIG. 11, the blank 100 may have a total length of about 12.125 inches (about 308 mm) and a total width of about 7.813 inches (about 198 mm) and a total area of about 94.73 square inches (about 61116 square millimeters). Such a blank 100, when assembled, may result in a carton 10 having a height of about 3.188 inches (about 81 mm), width of about 1.938 inches (about 49 mm), and length of about 5.063 inches (about 128 mm).

The length of the slot 150 from the first to the second intersections of the linear and arcuate portions 152 and 154 may be about 1.378 inches (about 35 mm), the maximum width of the slot 150 as measured from the linear portion 152 to an apex of the arcuate portion 154 may be about 0.185 inches (about 4.7 mm), the maximum length of the slot 150 as measured from the endpoint of the slit 156 to the endpoint of the slit 158 may be about 1.693 inches (about 43 mm), the length of each slit 156 and 158 may be about 0.157 inches (about 4 mm), and the arcuate portion 154 of the closure-tab shaped portion 144 may have a radius of curvature of about 1.823 inches (about 46 mm) and. The maximum length of the closure tab-shaped portion 144 may be about 1.693 inches (about 43 mm) and the maximum width of the closure tab-shaped portion 144 as measured from the fold line 133 to an apex of the closure tab-shaped portion 144 may be about 0.394 inches (about 10 mm), and the arcuate portion of the closure tab shaped portion 144 may have a radius of curvature of about 2.5 inches (about 63.5 mm). The closure tab-shaped portion 144 and the slot 150 may be shaped such that a ratio of the maximum width of the closure tab-shaped portion 144 to the maximum width of the slot 150 may be from about 2:1 to about 2.5:1. The maximum length of the closure tab-shaped portion 144 may be identical to the maximum length of the slot 150 or may be 0.039 to 0.078 inches (1 to 2 mm) greater than the maximum length of the slot 150.

The cutout portion 142 may have a length of about 2.688 inches (about 68 mm) and a width of about 0.563 inches (14 mm). The handle-shaped portion 140 may have a width of about 0.375 inches (about 9.5 mm) and a maximum height as measured from either of the fold lines 141 and 143 (about which the handle-shaped portion 140 pivots) to an upper edge of the handle-shaped portion 140 of about 0.938 inches (about 24 mm). While specific dimensions of the blank 100 and the assembled carton 10 are provided above, such dimensions are provided by way of example only, and the blank 100 and the carton 10 may have larger or smaller dimensions suitable for a type of product contained in the carton 10.

With the carton blank 100 positioned as shown in FIG. 11, the panels of the carton blank 100 may be sequentially folded about the fold lines of the carton blank 100 to assemble a carton 10 in a closed configuration as shown in FIG. 1. In particular, during assembly of the carton 10 from the blank 100, the panels 132 and 134 may be moved by pivoting relative to the panel 114 about the crease or fold lines 121*c* and 123*c*, respectively, in a direction toward each other and to a position where the panels 132 and 134 are substantially parallel to each other and perpendicular to the panel 114.

Then, the panels 124 and 126 may be moved by pivoting relative to the panel 116 about the crease or fold lines 121*a* and 123*a*, respectively, in a direction toward each other and to a position where the panels 124 and 126 are substantially parallel to each other and perpendicular to the panel 116. Similarly, the panels 128 and 130 may be moved by pivoting relative to the panel 118 about the crease or fold lines 121*b* and 123*b*, respectively, in a direction toward each other and to a position where the panels 128 and 130 are substantially parallel to each other and perpendicular to the panel 118.

The panels 116 and 118 may be moved by pivoting about the crease or fold lines 127 and 129, respectively, in a direction toward each other and to a position where the panels 116 and 118 are substantially parallel to each other and perpendicular to the panel 114. During this movement of the panels 116 and 118, portions of the panels 128 and 130 may overlay portions of the panels 132 and 134, respectively, while portions of the panels 124 and 126 may overlay both portions of the panels 128 and 130, respectively, and portions of the panels 132 and 134, respectively.

As discussed above, the panels 132 and 134 are optional and may be omitted from the blank 100. It will be appreciated that the panels 124 and 126 may be of varying lengths and may overlay a larger or smaller portion of the panels 128 and 130, respectively. In one optional form, instead of the panels 124 and 126 overlaying the panels 128 and 130, respectively, the panels 128 and 130 may overlay the panels 124 and 126. In another optional form, instead of having two panels 124 and 126, the blank 100 may include only one panel that is longer than each of the panels 124 and 126, and that may provide a single side panel of the assembled carton 10.

During assembly of the carton 10, portions of the panels 124 and 126 may be non-detachably attached via an adhesive to underlying portions of the panels 128 and 130. It will be appreciated that portions of the panels 124 and 126 may be non-detachably attached to respective portions of the panels 128 and 130 via suitable means other than an adhesive. With portions of the panels 124 and 126 being attached to respective portions of the panels 128 and 130, the carton 100 is assembled to a configuration substantially as shown in FIG. 7, with the panels 114, 116, 118, 124, 126, 128, and 130, defining an interior space where products 90, for example, crackers or cookies contained in a sealed bag 92, may be deposited.

With the products 90 deposited in the interior between the panels 114, 116, 118, 124, 126, 128, and 130 of the blank 100, the panels 136 and 138 of the blank 100 may be moved relative to the panel 120 by pivoting about the crease or fold lines 121*d* and 123*d*, respectively, in a direction toward each other and to a position where the panels 136 and 138 are substantially parallel to each other and perpendicular to the panel 120. So positioned, the panel 136 is positioned inwardly relative to the panels 124 and 128 and the panel 138 is positioned inwardly relative to the panels 126 and 130, and the panel 120 may be moved relative to the panel 116 by pivoting about the crease or fold line 131 in a direction toward the access opening 14 to a position where the panel 120 is substantially parallel to the panel 114 and substantially perpendicular to the panels 116 and 118, and where the panels 134 and 136 pass through the access opening through which the products 90 are deposited and the panel 120 substantially covers the products 90 and restricts removal of the products 90 through the access opening.

With the blank 100 being in a configuration substantially as shown in FIG. 6, adhesive may be applied to portions of the panel 120 to provide the adhesive areas 62 and 64 of the assembled carton 10 shown in FIG. 6. Then, the panel 122 may be moved in a direction toward the panel 120 by pivoting about the fold line 125 until the panel 122 is substantially perpendicular to the panel 116 and substantially parallel to the panel 120 and until an interior-facing surface of the panel 120 is in abutment with the exterior-facing surface of the panel 122 such that the panel 122 becomes detachably attached to the adhesive portions of the panel 120.

The closure tab-shaped portion 144 of the panel 122 may then be positioned to overlay the opening 150 and adjacent portions of the panel 120 to provide a carton 10 in the closed (unopened) configuration as shown in FIG. 1. Alternatively, the closure tab-shaped portion 144 of the panel 122 may be inserted into the opening 150 of the panel 120. It will be appreciated that positioning the closure tab-shaped portion 144 over to overlay the opening 150 may be achieved in one motion by simply folding the panel 122 together with the handle-shaped portion 140 and the closure tab-shaped portion 144 about the fold line 125 while the insertion of the tab-shaped portion 144 into the opening 150 may require an additional step of pushing the tab-shaped portion 144 into the opening 150 of the panel 120.

Thus, the exemplary carton 10 may be advantageously made from a single carton blank 100 of FIG. 11. The carton 10 may be advantageously transported and displayed at retail locations in the compact configuration of FIG. 1 where the handle 40 is down. The handle 40 is advantageously movable from the compact position to a deployed position of FIG. 3 to permit a user to carry the carton 10 by grasping the handle.

The top panels 20 and 22 may be quickly and easily opened to provide a user access to the products 90 in the carton by a simply pulling the handle 40 to pull the second top panel 22 away from the panel 20. The simplicity of opening of the carton 10 is advantageous for users such as young children. The closure tab 44 having the locking projections 46 and 48 advantageously provides for secure reclosure of the carton 10 after initial opening of the carton, and maintains the first and second top panels 20 and 22 of the carton interlocked and the carton 10 reclosed without the need for additional adhesive material to hold the first and second top panels 20 and 22 together even when a user uses the handle 40 to carry the carton 10 containing products 90 therein.

While the hinges depicted in the figures may be formed by folding a material from which the above described cartons may be made, the hinges could take other forms, and may have perforations or other lines of weakness for predetermining the location of the hinge. Although certain structures are described as being joined, connected, or attached to each other, it will be understood that this includes both direct and indirect or relative joining, sealing or attaching, e.g., with intermediate structures.

While preferred embodiments have been described in detail, variations and modifications can be effected within the configurations described herein.

The invention claimed is:

1. A carton for storing products therein, the carton comprising:

top, bottom, and side panels defining an interior configured to store products therein and an access opening configured to permit the products to be removed from the carton when the carton is in an open configuration, the top panels including a first top panel hingedly attached to one of the side panels and a second top panel hingedly connected to another of the side panels and being removably attached to and overlaying a portion of the first top panel such that the access opening of the carton is obstructed by the first and second top panels when the carton is in a closed configuration;

wherein the second top panel includes a handle at least partially defining an opening and a closure tab extending into the opening when coplanar with the handle, the closure tab including a first locking projection and a second locking projection extending therefrom;

wherein the first top panel includes a slot opening configured to receive both the first locking projection and the second locking projection of the closure tab; and wherein the slot opening in the first top panel has a perimeter with a linear portion and an arcuate portion that intersects the linear portion at two intersections.

2. The carton of claim 1, wherein the side panels include:

a front panel hingedly connected to the bottom panel and a rear panel hingedly connected to the bottom panel;

first and second major outer side panels each being hingedly connected to the rear panel; and third and fourth major outer side panels each being hingedly connected to the front panel and overlaying the first and second major outer side panels when the carton is in the closed configuration.

3. The carton of claim 2, wherein the bottom panel includes first and second minor bottom side panels hingedly connected to the bottom panel, and wherein, when the carton is in the closed configuration, the first minor bottom side panel extends along portions of the first and third major outer side panels, and the second minor bottom side panel extends along portions of the second and fourth major outer side panels.

4. The carton of claim 2, wherein the first top panel includes first and second minor top side panels hingedly connected to the first top panel, and wherein, when the carton is in the closed configuration, the first and second top side panels pass through the access opening into the interior, a third minor top side panel extending along portions of the first and third major outer side panels, and a fourth minor top panel extending along portions of the second and fourth major outer side panels.

5. The carton of claim 1, wherein the first top panel includes at least one adhesive area configured to permit detachable attachment of the first and second top panels when the first and second top panels abut.

6. The carton of claim 5, wherein the at least one adhesive area is at least partially surrounded by a line of weakness configured to facilitate detachment of the at least one adhesive area from the first top panel when the second top panel is moved away from the first top panel.

7. The carton of claim 1, wherein the handle has a first position, where the handle is adjacent the second top panel, and a second position, where the handle is upstanding relative to both the first and second top panels when in the closed configuration.

8. The carton of claim 7, wherein the handle is hingedly connected to the second top panel along at least one hinge line configured to permit movement of the handle from the first position to the second position.

9. The carton of claim 1, wherein the side panels of the carton include a front panel and a rear panel opposite the rear panel, and wherein the first and second top panels are hingedly connected to front and rear panels, respectively, and configured to pivot about their respective hinge lines from the closed configuration to an open configuration to unobstruct the access opening and permit access to the products in the interior.

10. The carton of claim 1, wherein the closure tab is hingedly connected to the second top panel and is permitted to pivot relative to the second top panel about a hinge.

11. The carton of claim 1, wherein, in the closed configuration, the first and second top panels are attached to each other by at least one adhesive area and the locking tab overlays the slot opening of the first top panel without being inserted into the slow of the first top panel.

12. The carton of claim 1, further comprising a reclosed configuration after initial opening of the carton, wherein, in the reclosed configuration, the first and second top panels are interlocked by the locking tab of the second top panel being received in the slot opening of the first top panel and without being attached to each other by at least one adhesive area.

13. The carton of claim 1, wherein the slot opening includes two slits at opposite ends of the slot opening, the slits extending in a direction away from each other from the intersections of the linear and arcuate portions of the slot opening.

14. The carton of claim 1, wherein a maximum length of the slot opening as measured from an end point of a first of the linear slits to an end point of a second of the linear slits is less than a maximum length of the closure tab as measured from an apex of the first locking projection to an apex of the second locking projection.

15. A method of opening the carton of claim 1, the method comprising:

moving the second top panel in a direction away from the first top panel to an intermediate open position to unobstruct the first top panel;

moving the first top panel in a direction away from the second top panel to unobstruct the access opening and permit access to the products in the interior of the carton.

16. The method of claim 15, wherein the moving of the second top panel in a direction away from the first top panel to an intermediate open position to unobstruct the first top panel includes pulling the handle in the direction away from the first top panel.

17. The method of claim 15, wherein the moving of the second top panel in a direction away from the first top panel to an intermediate open position to unobstruct the first top panel includes detaching the second top panel from the first top panel along at least one adhesive area.

18. The method of claim 15, wherein the moving of the second top panel in a direction away from the first top panel to an intermediate open position to unobstruct the first top panel includes raising the handle from a first position, where the handle is in one plane with the second top panel to a second position, where the handle is perpendicular to the second top panel.

19. The method of claim 15, wherein the moving of the second top panel in a direction away from the first top panel to an intermediate open position to unobstruct the first top panel includes moving the closure tab away from the slot opening in the first top panel.

* * * * *